US012405008B2

(12) United States Patent
Bentley et al.

(10) Patent No.: US 12,405,008 B2
(45) Date of Patent: Sep. 2, 2025

(54) APPARATUS FOR CONTROLLING AN AIR INLET VALVE FOR A SOLID FUEL BURNER

(71) Applicant: Otter Controls Limited, Fairfield (GB)

(72) Inventors: Richard Bentley, Buxton (GB); Andrew Hunt, Minehead (GB); Stephen Hollick, Buxton (GB)

(73) Assignee: Otter Controls Limited, Fairfield (GB)

( * ) Notice: Subject to any disclaimer, the term of this patent is extended or adjusted under 35 U.S.C. 154(b) by 561 days.

(21) Appl. No.: 17/748,826

(22) Filed: May 19, 2022

(65) Prior Publication Data

US 2022/0373184 A1 Nov. 24, 2022

(30) Foreign Application Priority Data

May 19, 2021 (GB) ..... 2107141

(51) Int. Cl.
*F24B 1/187* (2006.01)
*F24B 5/02* (2006.01)

(52) U.S. Cl.
CPC ..... *F24B 1/187* (2013.01); *F24B 5/023* (2013.01)

(58) Field of Classification Search
CPC ..... F24B 1/187; F24B 5/023
USPC ..... 126/77
See application file for complete search history.

(56) References Cited

U.S. PATENT DOCUMENTS 3,168,088 A * 2/1965 Martin ..... F24B 5/026 236/95
3,980,229 A * 9/1976 Stedman, Jr. ..... G05D 23/138 251/35
4,030,479 A * 6/1977 Webb ..... F23L 3/00 110/158
4,235,219 A * 11/1980 DeFoe ..... F24B 1/1895 236/101 E
4,691,686 A 9/1987 Alvarez
(Continued)

FOREIGN PATENT DOCUMENTS

DE 20003689 U1 5/2000
EP 2843311 A1 3/2015
(Continued)

OTHER PUBLICATIONS

Combined Search and Examination Report dated Jul. 19, 2021, issued in connection with UK Patent Application No. GB2107141.0 (3 pages).

(Continued)

*Primary Examiner* — Avinash A Savani
(74) *Attorney, Agent, or Firm* — McCarter & English, LLP

(57) ABSTRACT

Apparatus for controlling the flow of air through an air inlet in a solid fuel burner comprises: a mechanical temperature sensor for sensing the temperature within the solid fuel burner, the sensor comprising first and second elongate parts having different coefficients of linear thermal expansion and arranged such that a first end of the first elongate part moves linearly relative to a first end of the second elongate part in response to a change in the sensed temperature; a movable valve member for controlling the flow of air through the air inlet; and a mechanism for coupling the first end of the first elongate part to the movable valve member so as to close or restrict the air inlet as the sensed temperature increases.

18 Claims, 8 Drawing Sheets

(56) References Cited

U.S. PATENT DOCUMENTS

| | | | | |
|---|---|---|---|---|
| 5,465,905 | A * | 11/1995 | Elder | B05B 1/1609 239/533.1 |
| 6,041,770 | A * | 3/2000 | Erickson | F23N 3/047 126/285 R |
| 7,047,962 | B2 * | 5/2006 | Henry | F23L 3/00 126/77 |
| 7,325,541 | B2 * | 2/2008 | Marcakis | F24B 5/023 126/285 R |
| 9,605,851 | B2 * | 3/2017 | Marcakis | F24B 1/028 |
| 2008/0011286 | A1 * | 1/2008 | Almasri | F24B 1/1808 126/502 |
| 2012/0090596 | A1 * | 4/2012 | Miles | F23N 3/04 126/502 |

FOREIGN PATENT DOCUMENTS

| | | | |
|---|---|---|---|
| GB | 0465597 | A | 5/1937 |
| GB | 0738082 | A | 10/1955 |
| GB | 2165634 | A | 4/1986 |
| NL | 8105858 | A | 7/1983 |

OTHER PUBLICATIONS

Extended European Search Report dated Dec. 5, 2022, issued in connection with European Patent Application No. 22174421.2 (8 pages).

Notice of Intention to Grant dated Aug. 7, 2024, issued in connection with European Application No. 22174421.2, including Annex to EPO form 2004 and text intended for Grant (48 pages).

Decision to Grant dated Jan. 7, 2025, issued in connection with European Application No. 22174421.2 (3 pages).

* cited by examiner

APPARATUS FOR CONTROLLING AN AIR INLET VALVE FOR A SOLID FUEL BURNER

CROSS-REFERENCE TO RELATED APPLICATION

The present application claims the benefit of priority of United Kingdom (Great Britain) Patent Application No. 2107141.0 filed on May 19, 2021, the entire disclosure of which is expressly incorporated by reference herein.

FIELD OF THE INVENTION

This present invention relates to apparatus for controlling an air inlet valve for a solid fuel burner.

BACKGROUND OF THE INVENTION

Many people across the world rely on solid fuel for heating and cooking, particularly biomass such as wood, agricultural waste, charcoal and animal dung. The use of wood as a fuel is not restricted to developing countries. Many people in developed countries see wood burning as an ecological, carbon neutral option. If the wood is sourced sustainably the burning of wood for heating and cooking can approach carbon neutrality.

Unfortunately, the burning of wood has potentially harmful consequences in the form of the emission of harmful pollution in the form of small carbon particles. These are referred to as PM2.5 (particulate matter less than 2.5 microns in diameter). The emissions of PM2.5 from wood-burning stoves in Europe is already limited and legislation due in 2022 will reduce the limits to 40 $mg/m^3$.

The emission of PM2.5 particles can be reduced in a solid fuel burner by ensuring that the flue gas is above a specific temperature, allowing the particles to be fully combusted before they leave the burner. For example, the instructions issued with a wood-burning stove should provide guidance on how to adjust the damper or dampers on the stove to ensure that the correct temperature is maintained in the stove. Unfortunately, the users often do not understand the damper controls or appreciate the importance of maintaining a high temperature.

Automatically controlling the temperature of the flue gas can reduce the emission of PM2.5 particles, ensuring that the level of pollution is reduced and the stove meets the requirements of legislation both now and into the future.

Most existing solutions involve a mechanism for automatically closing an air inlet valve as a specified temperature is reached. The method of sensing the temperature can take a number of forms, each of which has some disadvantage.

The temperature can effectively be sensed using an electrical sensor such as a thermocouple or thermistor. A simple electronic circuit can sense when a specified temperature has been reached and cause a solenoid or motor to be energized to close the valve. One problem is that many stove installations do not have an electrical power supply and the user does not want the complication of batteries in what is perceived to be essentially a simple low technology appliance.

Some devices us the capillary thermostat principle. This uses a hollow metal bulb connected to a diaphragm with a small diameter tube. The bulb, tube and diaphragm are filled with a liquid or gas with a relatively high coefficient of thermal expansion. As the bulb is heated the fluid expands causing the diaphragm to move. This movement is used to close an air inlet valve. The problem with this system is that if the stove reaches excessively high temperatures the fluid expands to such an extent that the bulb, tube or diaphragm rupture.

A third type of sensor is a bimetal strip. This works on the principle of bonding two strips of metal with different coefficients of thermal expansion together. The resultant strip will bend when subjected to a change in temperature. The movement can be used to close an air inlet valve. The problem with thermal bimetals is that the maximum temperature they can withstand is 550° C. These high temperature bimetals are made using two different grades of stainless steel: an austenitic stainless steel with an expansion coefficient of typically $17.2\times10^{-6}$/K and a ferritic stainless steel with an expansion coefficient of typically $10.5\times10^{-6}$/K. At 550° C. the stress at the interface between the two types of stainless steel is sufficient to plastically deform the material. The result is the relationship between the temperature and the shape of the strip and hence the relationship between the temperature and the opening or closing of the valve will change if the stove reaches an excessively high temperature. One solution to this is to locate the bimetal outside the stove and conduct the heat to the bimetal using a metal with a high coefficient of thermal conduction, such as copper or brass. The effect of this is to increase the response time of the device and also to add an unknown variable since the temperature difference between the inside of the stove and the outside can be influenced by the ambient conditions surrounding the stove installation.

SUMMARY

In some embodiments, apparatus for controlling the flow of air through an air inlet in a solid fuel burner comprises: a mechanical temperature sensor for sensing the temperature within the solid fuel burner, the sensor comprising first and second elongate parts having different coefficients of linear thermal expansion and arranged such that a first end of the first elongate part moves linearly in the elongate direction relative to a first end of the second elongate part in response to a change in the sensed temperature; a movable valve member for controlling the flow of air through the air inlet; and a mechanism for coupling the first end of the first elongate part to the movable valve member so as to close or restrict the air inlet as the sensed temperature increases.

At least some embodiments of the invention comprise a mechanical device which relies on the different thermal expansion coefficients of two materials. However instead of configuring the materials as a bimetallic strip, the difference in the change of length of two components made from the two materials is used to sense the temperature. For example, if a rod made from a low expansion material is mounted inside a tube of relatively high expansion material and one end of each is fixed firmly together, a change in temperature will result in a relative movement of the free end of the rod, in the direction of the length of the rod, with respect to the free end of the tube. If the temperature is increased the free end of the rod will move towards its fixed end. A decrease in temperature will result in a movement away from the fixed end.

An advantage of this arrangement is that the resultant movement is dependent on the average temperature change along the length of the two components. Another is that unlike in a bimetal driven system, the force available to be applied by the relative movement is very high and only limited by the buckling force of the rod or tube.

The assembly of rod and tube can be made of any suitable materials with differing coefficients of thermal expansion.

An alloy typically used in this type of temperature sensor is an iron/nickel alloy commonly referred to as Invar. The most common composition for this alloy is 36% nickel, with iron making up the balance. This alloy has a coefficient of thermal expansion of virtually zero between −100° C. to 200° C. At 150° C. the coefficient is $2\times10^{-6}$/K, at 250° C. the coefficient is $4\times10^{-6}$/K, and at 400° C. the coefficient is $8\times10^{-6}$/K.

The problem of the increased coefficient of Invar type alloys at high temperatures can be overcome by using a suitable ceramic material. One such material is cordierite, for which the coefficient of expansion is less than $2\times10^{-6}$/K across a wide temperature range. Another suitable material is quartz, for which the coefficient of expansion is 5.5×10−7/K between 20° C. and 300° C. Another suitable material is borosilicate glass.

Brass or copper have very high coefficients of expansion, so are suitable for the material with a high coefficient. Copper has a coefficient of $17.7\times10^{-6}$/K (average 20° C.-300° C.), and brass has a coefficient of $21\times10^{-6}$/K (average 20° C.-300° C.)

However the combustion gases present in a woodburning stove can be corrosive to copper and brass. A protective coating can be applied to overcome these issues. One suitable coating is nickel which can be applied electrochemically or using an electroless nickel process.

Another suitable material with a high coefficient of expansion is stainless steel, especially the austenitic or face centered cubic types. A suitable grade of stainless steel is grade 321 (SS321) or 1.4341, which has titanium added making it corrosion resistant at high temperatures. SS321 has a coefficient of $17\times10^{-6}$/K (average 20° C.-300° C.).

An assembly of a SS321 tube and a quartz rod within the tube provides a suitable differential expansion. An assembly with a 300 mm tube and rod would result in a relative motion of approximately 0.005 mm per degree Kelvin and a motion of approximately 2 mm for a temperature change of 400K. This degree of motion is not enough to open or close a valve, so a suitable mechanical system is required to amplify the motion. This can be achieved with a simple lever mechanism.

An alternative arrangement is to replace the tube with one or preferably a plurality of rods. The rods can be joined together at their fixed ends. This allows the material with the higher coefficient of expansion to be in the center of the assembly whilst still exposing it directly to the hot flue gasses. This system can be arranged so that the mechanism is not damaged if the stove reaches excessive temperatures. If the tube is made from the material with the greater coefficient of expansion the end of the rod will move away from the lever if an excessive temperature is reached. If the rod is made from the material with the higher coefficient a similar system can be employed by creating a head or step on the end of the rod.

The rod(s) or tube typically have a length in the range 200-500 mm, so as to give sufficient relative motion for the temperature range encountered in a solid fuel burner.

BRIEF DESCRIPTION OF THE DRAWINGS

There now follows, by way of example only, a detailed description of embodiments of the present invention, with reference to the figures identified below.

DETAILED DESCRIPTION OF THE EMBODIMENTS

Figure 1A:
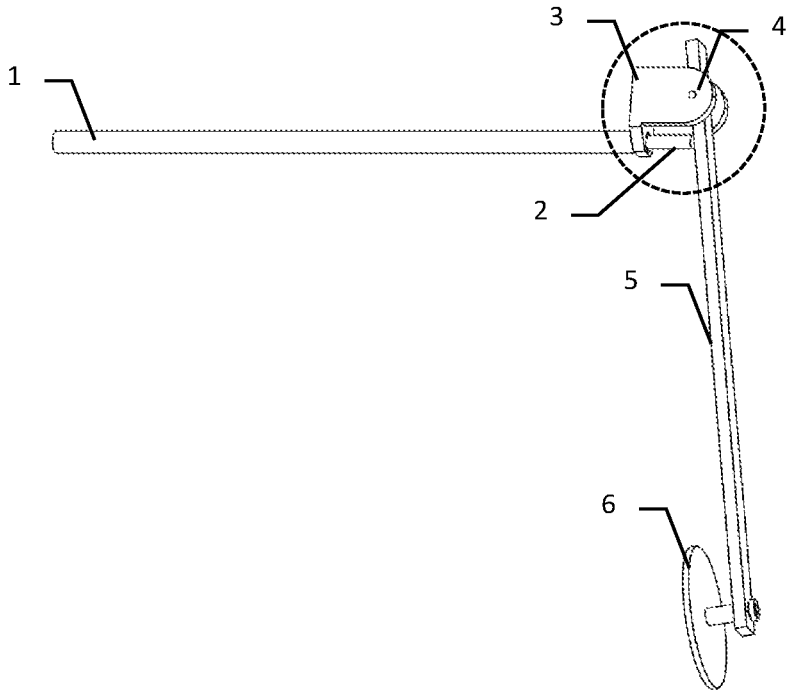
FIGS. 1*a* and 1*b* show perspective views of a valve assembly in a first embodiment, with FIG. 1*b* showing in detail the area outlined in FIG. 1*a*.

In the following description, functionally similar parts are indicated using the same reference numerals. References to directions such as clockwise or anticlockwise are with reference to the figures as shown. Parts may be omitted in some of the figures, for example to show other parts more clearly.

Figure 1B:
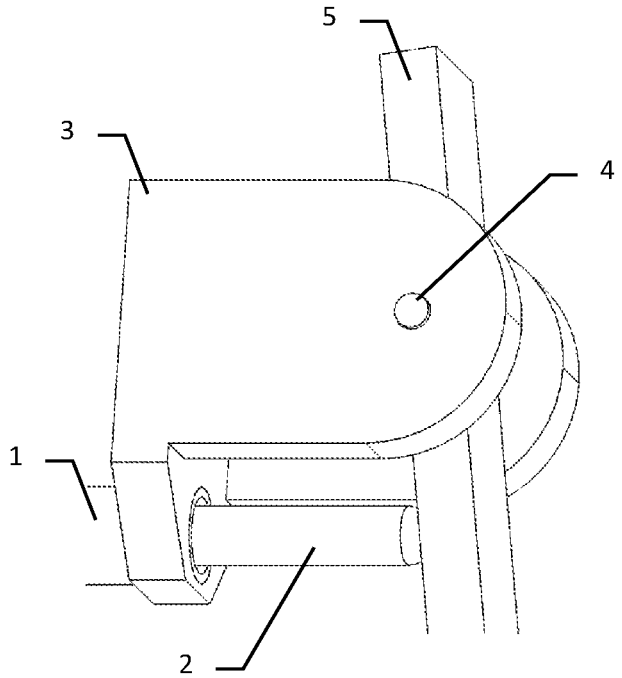
Figure 1C:
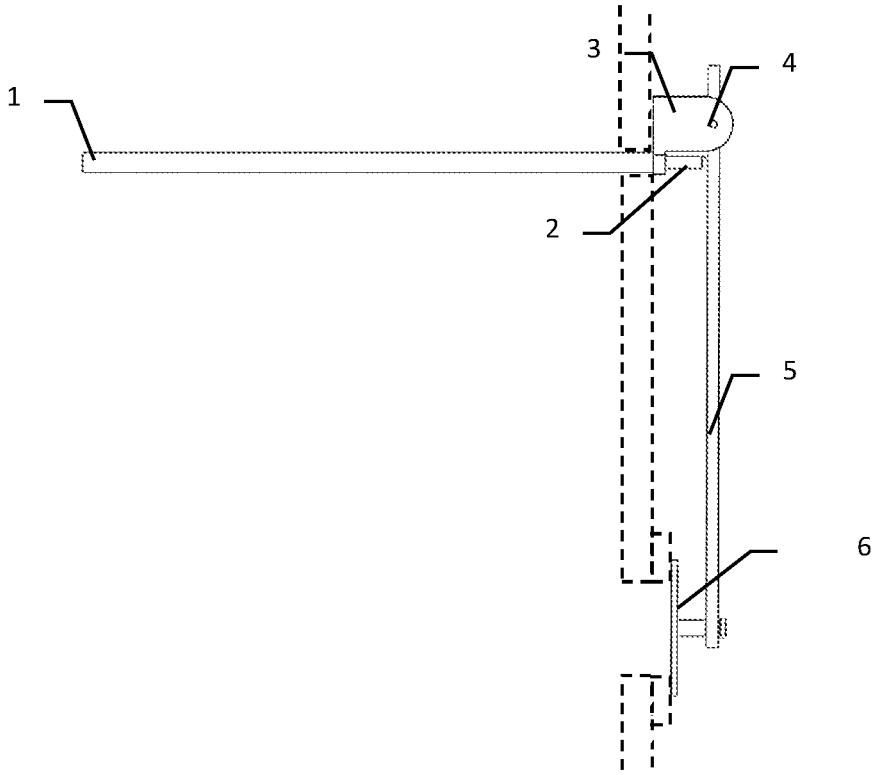
FIGS. 1*c* and 1*d* show side views of the valve assembly of the first embodiment in respectively closed and open states.

FIGS. 1*a*-1*d* show the valve assembly of the first embodiment, with a temperature sensor comprising a tube 1 of relatively high coefficient of thermal expansion and an actuating rod 2 of relatively low coefficient of thermal expansion, positioned within the tube 1. The tube 1 is fixed at one end to a bracket 3 which supports a pivot 4 for a lever 5. FIG. 1*b* shows an enlarged view of the bracket 3 and tube 1 with the actuating rod 2 projecting from the tube 1. The ends of the actuating rod 2 and tube 1 distal to the bracket 3 are fixed together by a suitable means such as a bush. The outside diameter of the actuating rod 2 is smaller than the inside diameter of the tube 1 allowing relative longitudinal motion of the free ends of the actuating rod 2 and tube 1 due to differential thermal expansion.

The free end of the actuating rod 2 bears on the lever 5 which pivots about the pivot 4 on the bracket 3. When the tube 1 and actuating rod 2 cool, the length of the tube 1 decreases more than the length of the actuating rod 2, so that the length of the actuating rod 2 protruding out of the tube 1 increases. When the temperature increases, the length of the tube 1 increases more than length of the actuating rod 2, so that the length of the actuating rod 2 protruding out of the tube 1 decreases. The change in the length of the actuating rod 2 protruding out of the tube 1 allows the lever 5 to pivot. The lever 5 is biased against the end of the actuating rod 2, for example by means of a spring (not shown) and/or by gravity. A moving valve part 6 is mounted at the end of the lever 5.

Figure 1D:
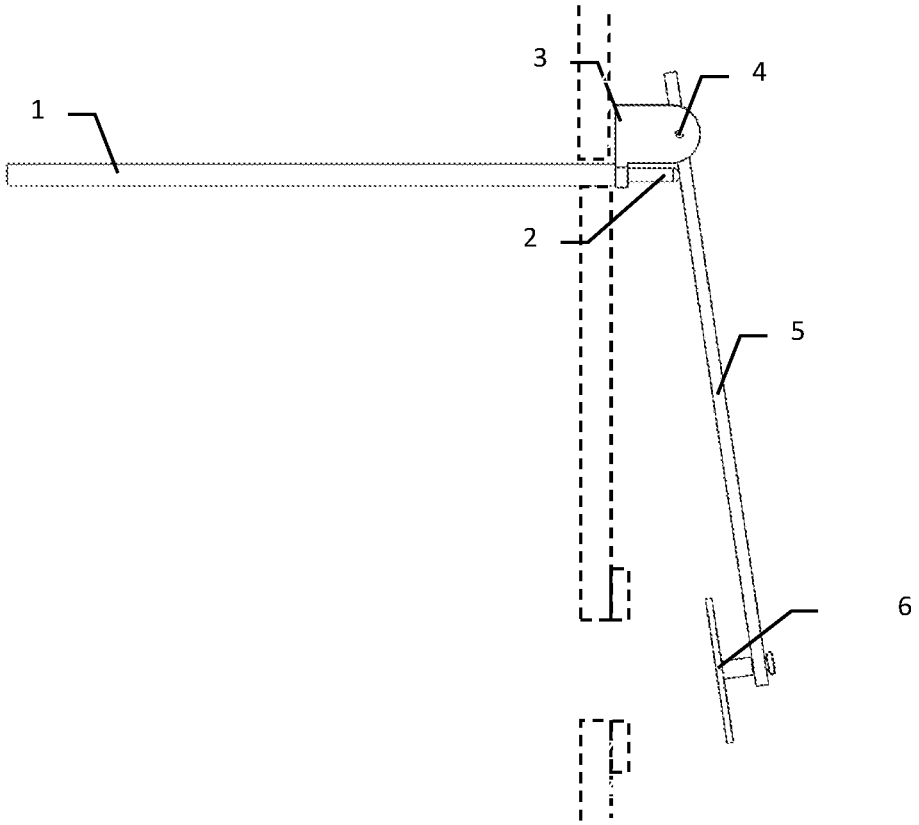

The bracket 3 may be mounted on the outer surface of a side wall of a solid fuel burning stove, shown in dashed outline, with the tube 1 and actuating rod 2 projecting through an aperture in the side wall into the stove and the lever 5 extending vertically downwards from the bracket 3. The moving valve part 6 may be a flap which moves into contact with an air inlet on the side wall of the stove so as to block or restrict the air inlet when the valve assembly is in the closed state, as shown in FIG. 1*d*.

If the temperature increases excessively above the temperature at which the valve assembly moves to the closed state, the protrusion of the end of the actuating rod 2 past the end of the tube 1 continues to decrease, causing the actuating rod 2 to lose contact with or decouple from the lever 5, thereby preventing further movement of the moving valve part 6 and ensuring that no damage is sustained due to the excessive temperature.

Figure 7:
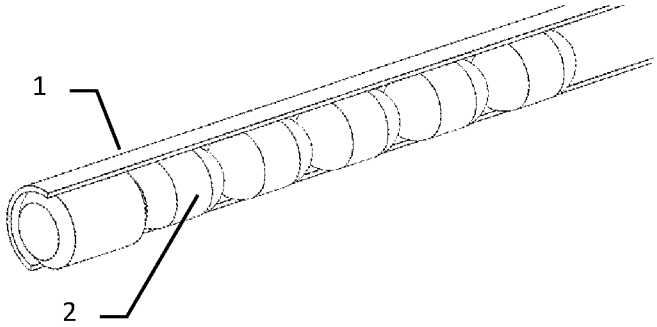
FIG. 7 shows a cutaway view of an alternative temperature sensor arrangement for use in embodiments of the invention.

FIG. 7 shows an alternative arrangement in which the actuating rod 2 comprises a plurality of discrete elements or segments, such as beads or spheres, in sliding arrangement within the tube 1 and in end-to-end contact. This arrangement is particularly suitable where the actuating rod 2 comprises fragile material, such as quartz or ceramic.

Figure 2A:
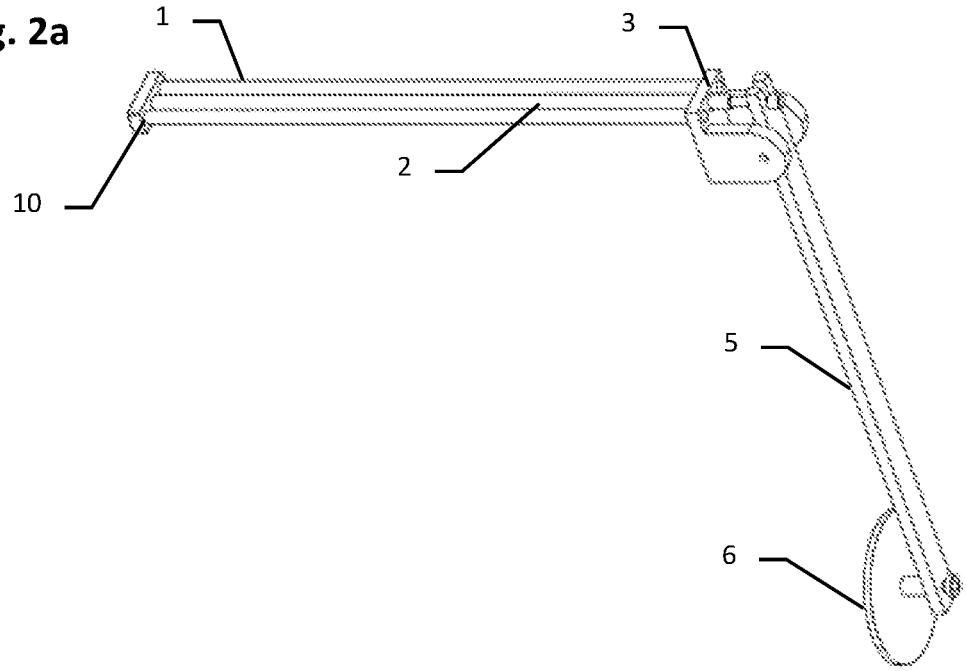
FIG. 2*a* shows a perspective view of a valve assembly in a second embodiment.
Figure 2B:
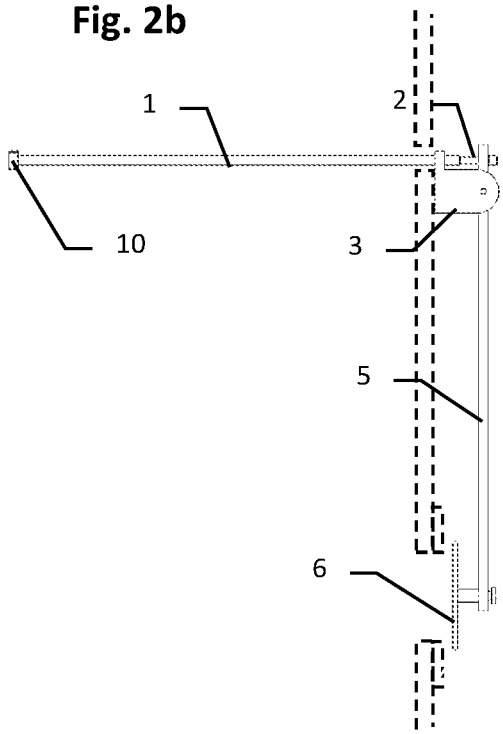
FIGS. 2*b* and 2*c* show side views of the valve assembly of the second embodiment in respectively closed and open states.
Figure 2C:
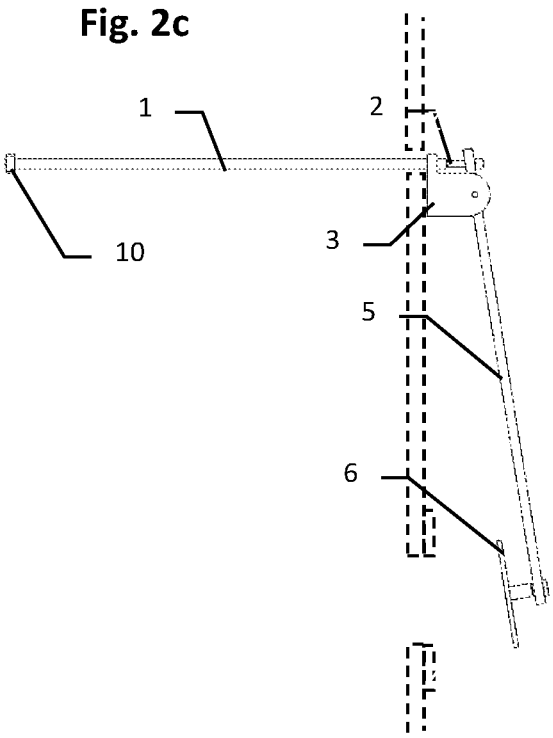

FIGS. 2*a* to 2*c* show a valve assembly in a second embodiment, which differs from the first embodiment in that a free end of an actuating rod 2 of high coefficient of thermal expansion is coupled to the lever 5, for example by means of a step or portion of reduced diameter that fits within a slot in one end of the lever 5. This portion extends over a sufficient length of the actuating rod 2, such that the actuating rod 2 can continue to increase in length in excessive temperatures, without applying force to the end of the lever 5. Alternatively, the rod 2 may have a head portion of increased diameter.

To ensure that the lever 5 moves in the required direction in response to a change in temperature, the pivot 4 is located between the end of the lever 5 and the moving valve part 6 i.e. the lever 5 is a first order lever rather than the third order lever of the first embodiment.

Instead of tube 1 in the first embodiment, the bracket 3 is connected to first ends of a pair of fixed rods 1 of low coefficient of thermal expansion, with second ends of the fixed rods 1 being connected to a fixed end of the actuating rod 2 of high coefficient of thermal expansion, by means of a connector 10.

Alternatively, the fixed rods 1 could be omitted and the fixed end of the actuating rod 2 could be supported by a structural part within the interior of the burner, for example an opposite inner side wall. In another alternative, a pair of brackets 3 may be installed on opposite side walls of the burner, with the actuating rod passing through apertures in the opposite side walls and actuating corresponding levers on the opposite side walls. Hence, at least where the actuating rod has a high coefficient of linear thermal expansion, all that is needed is for the actuating rod 2 to be supported in some way so as to be able to actuate a mechanism for closing the air inlet when the temperature increases above a threshold.

Figure 3A:
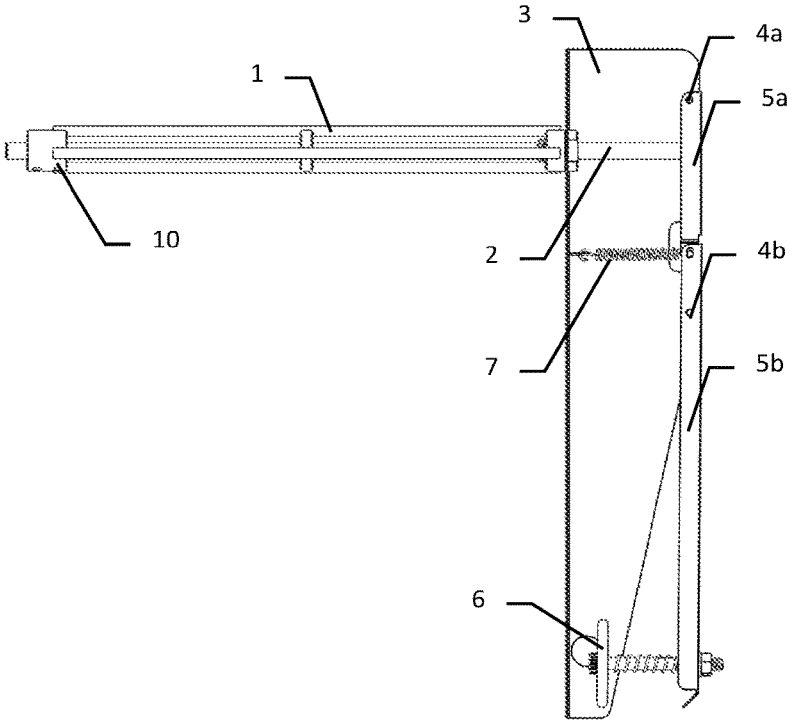
FIG. 3*a* shows a side view of a valve assembly in a third embodiment.
Figure 3B:
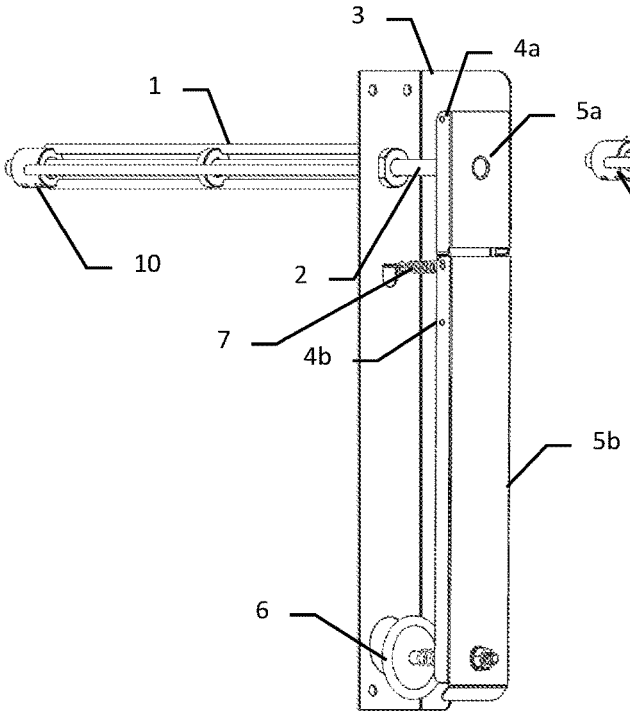
FIGS. 3*b* and 3*c* are perspective views of the valve assembly of third embodiment in respectively closed and open states.
Figure 3C:
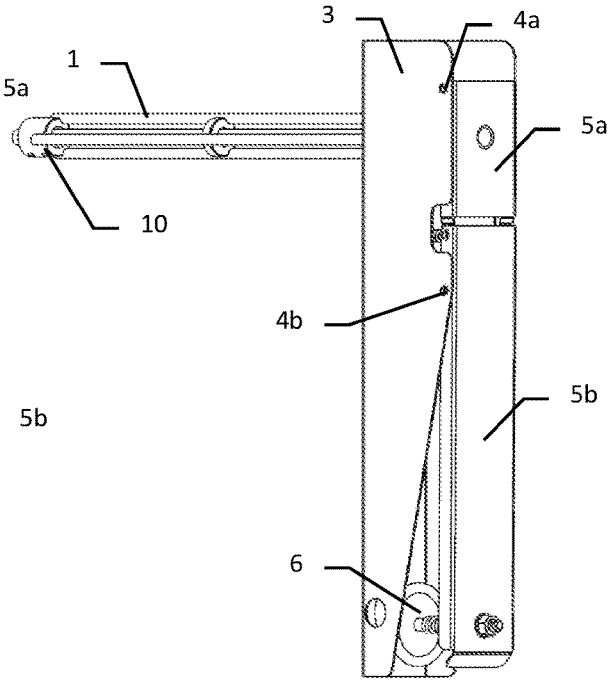

FIGS. 3*a*-3*c* shows a valve assembly of a third embodiment, in which the lever 5 is actuated by the free end of actuating rod 2 of high coefficient of thermal expansion, and the bracket 3 is connected to the fixed end of the actuating rod 2 by a plurality (in this case, four) of fixed rods 1 of low coefficient of thermal expansion, as in the second embodiment. However, in this embodiment the lever 5 comprises two coupled levers 5*a*, 5*b* that provide a greater movement of the moving valve part 6 for a given movement of the free end of the actuating rod 2 and/or allow the length of the lever 5 to be reduced.

The free end of the actuating rod 2 acts on the first lever 5*a*, arranged as a third order lever, causing it to rotate counter-clockwise around its pivot 4*a* as the temperature of the actuating rod 2 increases. The free end of the first lever 5*a* acts on a first end of the second lever 5*b*, arranged as a first order lever, causing the second lever 5*b* to rotate clockwise about its pivot 4*b* so as to move the moving valve part 6, attached to a second end of the second lever 5*b*, into its closed position. The free end of the first lever 5*a* and the first end of the second lever 5*b* are biased towards the bracket 3 by a spring 7.

The first lever 5*a* amplifies the movement of the free end of the actuating rod according to the ratio of the distances of the free end of first lever 5*a*, and that of the point of contact of the free end of the actuating rod 2, to the first pivot 4*a*. The second lever 5*b* further amplifies this movement by the ratio of the distances of the second end and the first end of the second lever 5*b* to the second pivot 4*b*, so that the total amplification is the multiple of these two ratios.

Figure 4A:
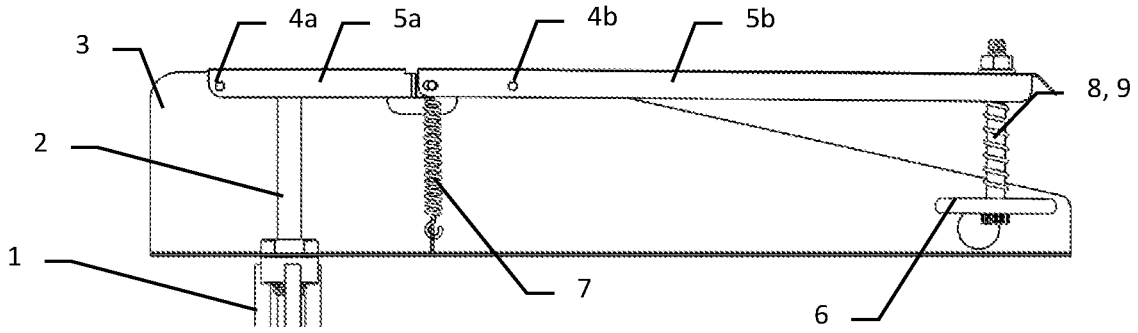
FIGS. 4*a* to 4*c* are side views of the valve assembly of the third embodiment in respectively open, closed and overtemperature states.
Figure 4B:
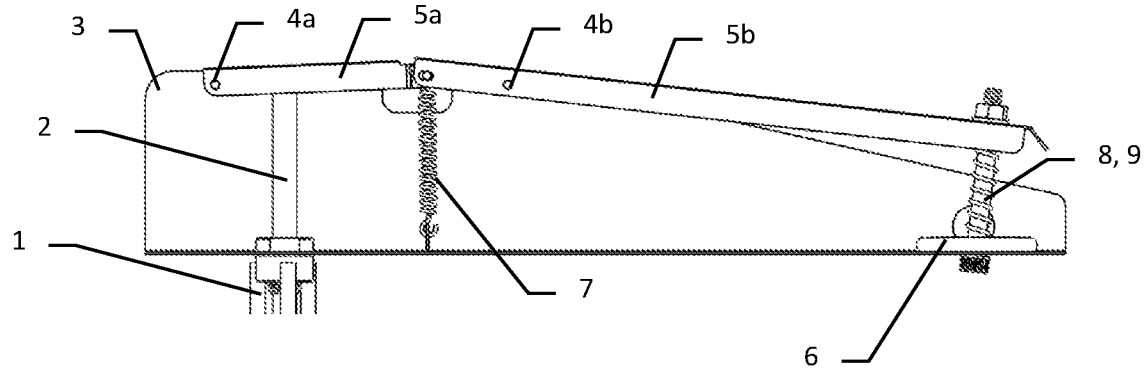
Figure 4C:
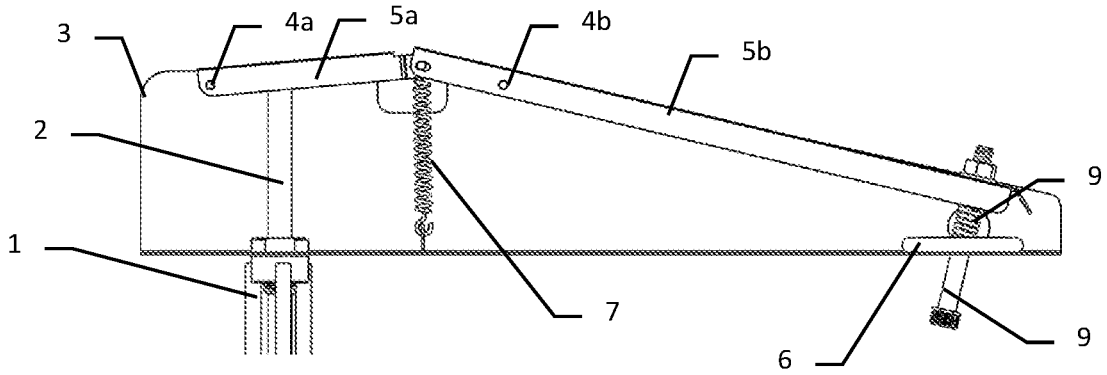
Figure 5A:
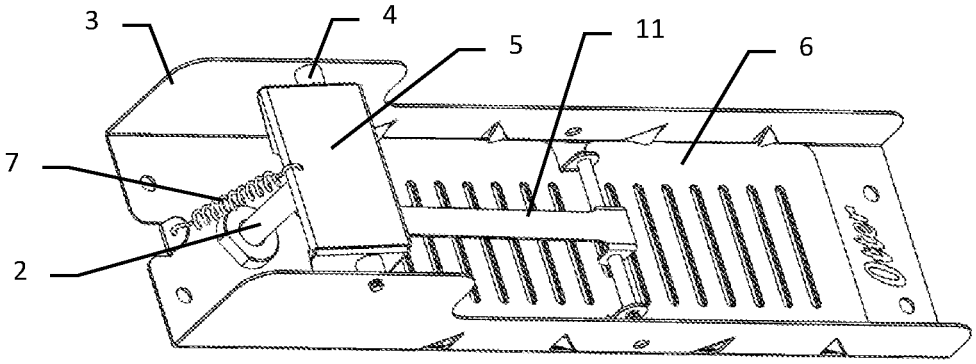
FIG. 5*a* is a perspective view of a valve assembly in a fourth embodiment.
Figure 5B:
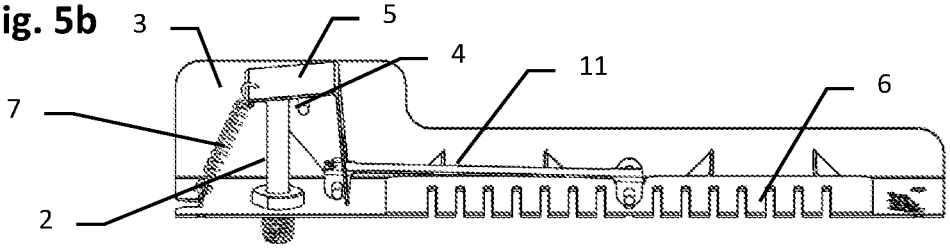
FIGS. 5*b*, 5*c* and 5*d* are side views of the valve assembly of the fourth embodiment in respectively open, closed and overtemperature states.
Figure 5C:
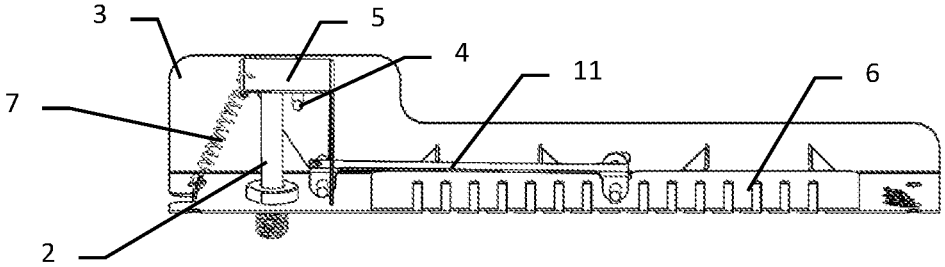
Figure 5D:
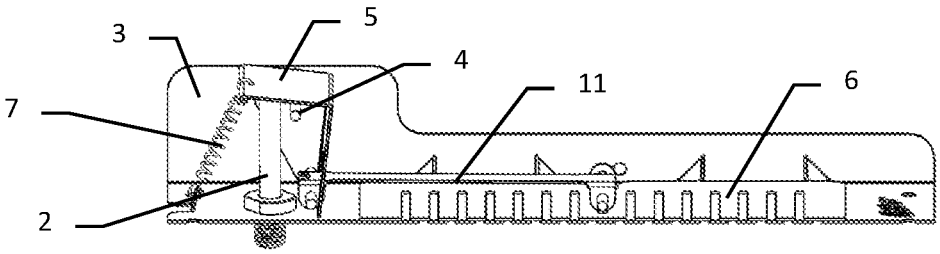

FIGS. 4*a*-4*c* show how one way to provide overtravel in the third embodiment to avoid damage when the temperature exceeds the that when the valve is fully closed. FIG. 4*a* shows the valve in the cold, open position and FIG. 4*b* shows the valve in the hot, closed position. FIG. 4*c* shows the valve in an excessively hot state; the levers 5*a*, 5*b* have continued to rotate past the closed position. The moving valve part 6 is slidably mounted on a shaft 8 and biased to the end of the shaft 8 by a spring 9, allowing the second lever 5*b* to continue to rotate even though the moving valve part 6 is in the closed position, as the shaft 8 slides through the moving valve part 6.

FIGS. 5*a*-5*d* show a fourth embodiment which uses a moving valve part 6 that slides parallel to the air inlet opening. In this embodiment, the actuating rod 2 acts on one end of a pivoting crank lever 5 mounted on the bracket 3. A connecting rod 11 is coupled between the other end of the crank lever 5 and the moving valve part 6, which is configured as a sliding hit-and-miss vent cover within a vent portion of the bracket 3, comprising a series of slots.

Figure 8:
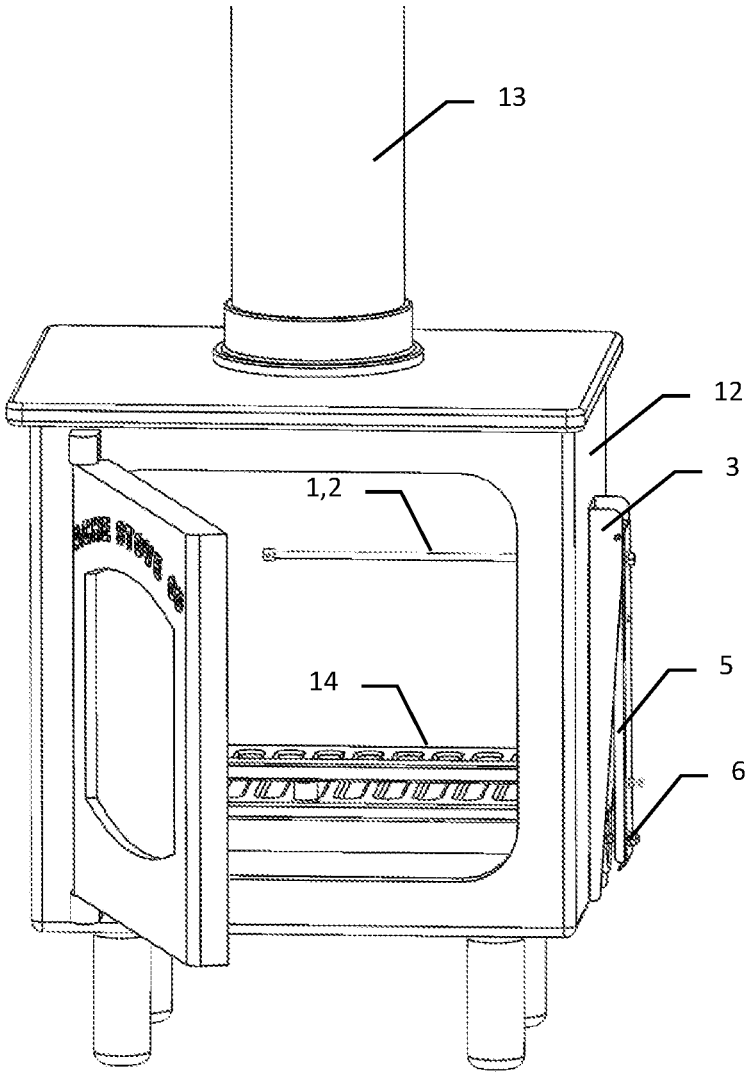
FIG. 8 shows a valve assembly of an embodiment of the invention, installed in a wood-burning stove.

In the above embodiments, the moving valve part 6 is positioned some distance away from the temperature sensing parts, such as the fixed rods/tube 1, 2. This may be suitable where it is desirable to sense the temperature in an upper part of the stove or burner, for example just below a flue, but where the air inlet needs to be provided at a lower part of the stove or burner to allow combustion of particles. One such arrangement is shown in FIG. 8, where the bracket 3 is fitted to the outer surface of a side wall 12 of a wood-burning stove, with the temperature sensor 1,2 projecting through an aperture in the side wall 12 into the interior of the stove and under a flue 13. The sensor 1, 2 may project perpendicularly or at an angle to the side wall 12. The air inlet is located in a lower part of the side wall 12, adjacent to a grate 14.

Figure 6A:
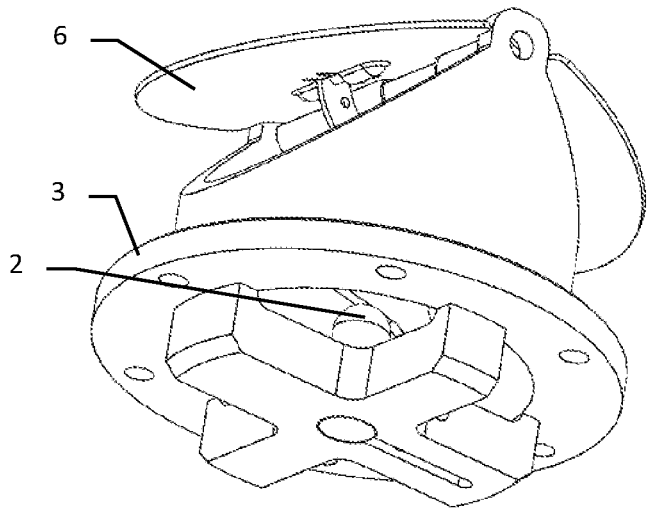
FIG. 6*a* is a perspective view of a valve assembly of the fifth embodiment.
Figure 6B:
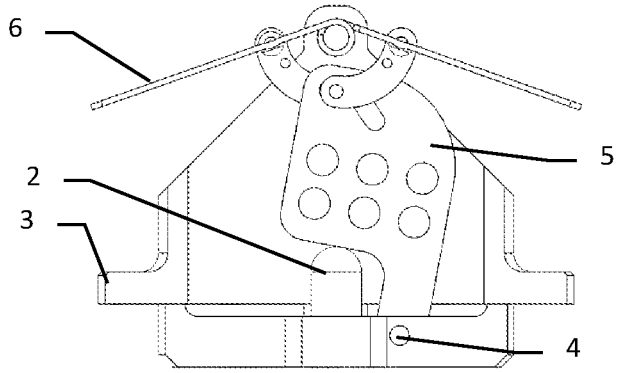
FIGS. 6*b* and 6*c* are cutaway side views of the valve assembly of the fifth embodiment in respectively open and closed positions.
Figure 6C:
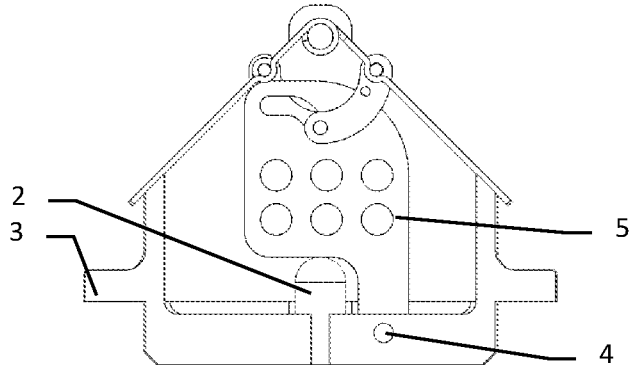

Alternatively, in some stoves it may be desirable to place the air inlet part of the valve close to the temperature sensor 1,2. In this case the valve arrangement in a fifth embodiment as shown in FIGS. 6*a* to 6*c* can be adopted. In this embodiment the valve is actuated by the free end of actuating rod 2 of low coefficient of thermal expansion. The free end of the actuating rod 2 passes through an aperture in the bracket 3; the remainder of the actuating rod 2, and fixed rods or tube 1 connected between the bracket 3 and the fixed end of the actuating rod 2 are not shown.

The free end of the actuating rod 2 actuates a pivoting lever 5 which acts to open and close a pair of moving valve parts 6 or flaps by means of a cam mechanism formed by a slot in the lever 5 and a pin connected to the moving valve members 6, which are biased into a closed position, for example by a spring.

In some embodiments of the invention, the moving valve member(s) 6 may be manually moved to an open or closed position, overriding the actuation by the temperature sensor. In particular, it may be desirable to allow the valve member (s) 6 to be manually moved to an open position, but not to a closed position. This may be achieved for example by a manually operable latch that latches the lever 5 and/or the valve member 6 in an open position.

Alternative Embodiments

Although the above embodiments have been described with reference to stoves such as wood or coal burning stoves, embodiments of the invention may also be applied to solid fuel burners of other types such as ovens and ranges.

In some embodiments, individual features as described above may be combined or omitted. On reading the above description, the skilled person may contemplate alternative embodiments which nevertheless fall within the scope of the accompanying claims.

The invention claimed is:

1. An apparatus for controlling flow of air through an air inlet in a solid fuel burner, the apparatus comprising:
   a. a mechanical temperature sensor for sensing temperature within the solid fuel burner, the sensor comprising first and second elongate parts, the first elongate part having a first end that moves linearly in a direction of a length of the first elongate part, due to a difference in thermal expansion coefficients of the materials of the first and second elongate parts, in response to a change in the sensed temperature, wherein the first elongate part has a high coefficient of thermal expansion relative to the second elongate part; and
   b. a movable valve member for controlling the flow of air through the air inlet, the moveable valve member being coupled to the first end of the first elongate part so as to close or restrict the air inlet as the sensed temperature increases.

2. The apparatus of claim 1, wherein a second end of the first elongate part is fixed relative to a second end of the second elongate part.

3. The apparatus of claim 2, wherein the first and second elongate parts extend in a parallel direction, with the positions of the second ends of the first and second elongate parts being fixed relative to one another in said parallel direction.

4. An apparatus for controlling flow of air through an air inlet in a solid fuel burner, the apparatus comprising:
   a. a mechanical temperature sensor for sensing temperature within the solid fuel burner, the sensor comprising first and second elongate parts, the first elongate part having a first end that moves linearly in a direction of a length of the first elongate part, due to a difference in thermal expansion coefficients of the materials of the first and second elongate parts, in response to a change in the sensed temperature; and
   b. a movable valve member for controlling the flow of air through the air inlet, the moveable valve member being coupled to the first end of the first elongate part so as to close or restrict the air inlet as the sensed temperature increases,
   wherein a second end of the first elongate part is fixed relative to a second end of the second elongate part,
   wherein the first and second elongate parts extend in a parallel direction, with the positions of the second ends of the first and second elongate parts being fixed relative to one another in said parallel direction, and
   wherein the second elongate part comprises an elongate tube within which the first elongate part is located, the first end of the first elongate part projecting from the first end of the tube.

5. The apparatus of claim 4, wherein the first elongate part comprises a plurality of discrete elements located within the elongate tube.

6. An apparatus for controlling flow of air through an air inlet in a solid fuel burner, the apparatus comprising:
   a. a mechanical temperature sensor for sensing temperature within the solid fuel burner, the sensor comprising first and second elongate parts, the first elongate part having a first end that moves linearly in a direction of a length of the first elongate part, due to a difference in thermal expansion coefficients of the materials of the first and second elongate parts, in response to a change in the sensed temperature; and
   b. a movable valve member for controlling the flow of air through the air inlet, the moveable valve member being coupled to the first end of the first elongate part so as to close or restrict the air inlet as the sensed temperature increases,
   wherein a second end of the first elongate part is fixed relative to a second end of the second elongate part,
   wherein the first and second elongate parts extend in a parallel direction, with the positions of the second ends of the first and second elongate parts being fixed relative to one another in said parallel direction, and
   wherein the second elongate part comprises one or more rods extending parallel to the first elongate part.

7. An apparatus for controlling flow of air through an air inlet in a solid fuel burner, the apparatus comprising:
   a. a mechanical temperature sensor for sensing temperature within the solid fuel burner, the sensor comprising first and second elongate parts, the first elongate part having a first end that moves linearly in a direction of a length of the first elongate part, due to a difference in thermal expansion coefficients of the materials of the first and second elongate parts, in response to a change in the sensed temperature; and
   b. a movable valve member for controlling the flow of air through the air inlet, the moveable valve member being coupled to the first end of the first elongate part so as to close or restrict the air inlet as the sensed temperature increases,
   wherein a second end of the first elongate part is fixed relative to a second end of the second elongate part, and
   wherein the first elongate part has a low coefficient of thermal expansion relative to the second elongate part.

8. The apparatus of claim 7, wherein the first elongate part comprises a ceramic material such as cordierite, or quartz or borosilicate glass.

9. The apparatus of claim 7, wherein the second elongate part comprises copper, brass or stainless steel.

10. The apparatus of claim 1, wherein the first elongate part comprises copper, brass or stainless steel.

11. The apparatus of claim 1, wherein the moveable valve member is coupled to the first end of the first elongate part by a mechanism arranged to amplify movement of the first end of the first elongate part.

12. The apparatus of claim 11, wherein the mechanism comprises a lever mechanism.

13. An apparatus for controlling flow of air through an air inlet in a solid fuel burner, the apparatus comprising:

a. a mechanical temperature sensor for sensing temperature within the solid fuel burner, the sensor comprising first and second elongate parts, the first elongate part having a first end that moves linearly in a direction of a length of the first elongate part, due to a difference in thermal expansion coefficients of the materials of the first and second elongate parts, in response to a change in the sensed temperature; and b. a movable valve member for controlling the flow of air through the air inlet, the moveable valve member being coupled to the first end of the first elongate part so as to close or restrict the air inlet as the sensed temperature increases, wherein the moveable valve member is coupled to the first end of the first elongate part by a lever mechanism arranged to amplify movement of the first end of the first elongate part, the lever mechanism comprising at least first and second levers coupled together such that the second lever amplifies motion of the first lever.

14. An apparatus for controlling flow of air through an air inlet in a solid fuel burner, the apparatus comprising:

a. a mechanical temperature sensor for sensing temperature within the solid fuel burner, the sensor comprising first and second elongate parts, the first elongate part having a first end that moves linearly in a direction of a length of the first elongate part, due to a difference in thermal expansion coefficients of the materials of the first and second elongate parts, in response to a change in the sensed temperature; and b. a movable valve member for controlling the flow of air through the air inlet, the moveable valve member being coupled to the first end of the first elongate part so as to close or restrict the air inlet as the sensed temperature increases, wherein the moveable valve member is coupled to the first end of the first elongate part by a mechanism arranged to amplify movement of the first end of the first elongate part, the mechanism being arranged to prevent further movement of the movable valve member when the sensed temperature is above a high temperature at which the valve member is in a closed or restricted position.

15. The apparatus of claim 14, wherein the mechanism is arranged to decouple from the movable valve member when the sensed temperature is above said high temperature.

16. The apparatus of claim 14, wherein the mechanism is arranged to decouple from the first end of the first part when the sensed temperature is above said high temperature.

17. A solid fuel burner including the apparatus of claim 1.

18. An apparatus for controlling the flow of air through an air inlet in a solid fuel burner, the apparatus comprising:

a. a mechanical temperature sensor for sensing temperature within the solid fuel burner, and b. a movable valve member for controlling the flow of air through the air inlet, the movable valve member being coupled to the mechanical temperature sensor so as to close or restrict the air inlet as the sensed temperature increases;

wherein the sensor comprises an elongate part having a moveable end that moves linearly in the direction of the length of the elongate part by virtue of thermal expansion or contraction of the material of the elongate part in response to a change in the sensed temperature; and wherein the movable valve member is coupled to the moveable end of the elongate part, and wherein the elongate part comprises copper, brass or stainless steel.

* * * * *